US005931134A

United States Patent [19]

Kudryashov

[11] Patent Number: 5,931,134

[45] Date of Patent: Aug. 3, 1999

[54] INTERNAL COMBUSTION ENGINE WITH IMPROVED COMBUSTION

[75] Inventor: Dmitriy Mikhaylovich Kudryashov, Cheboksari, Russian Federation

[73] Assignee: Devik International, Inc., New York, N.Y.

[21] Appl. No.: 08/851,290

[22] Filed: May 5, 1997

[51] Int. Cl.[6] ..... F02M 3/00

[52] U.S. Cl. ..... 123/188.1; 123/80 R; 123/188.4; 123/190

[58] Field of Search ..... 123/188.1, 188.4, 123/80 R, 81, 190

[56] References Cited

U.S. PATENT DOCUMENTS

| | | | |
|---|---|---|---|
| 401,240 | 9/1889 | Atwood . | |
| 1,015,948 | 1/1912 | Forest | 123/188.4 |
| 1,127,924 | 2/1915 | Roots | 123/188.4 |
| 1,140,206 | 5/1915 | Swackhammer . | |
| 1,200,478 | 10/1916 | Frink . | |
| 1,213,391 | 1/1917 | McCray et al. . | |
| 1,267,787 | 5/1918 | Nance . | |
| 1,295,013 | 2/1919 | Duvall . | |
| 1,661,558 | 3/1928 | Burtnett . | |
| 1,670,293 | 5/1928 | Anglada . | |
| 1,673,340 | 6/1928 | Schaeffer . | |
| 1,682,088 | 8/1928 | Neubauer . | |
| 1,705,894 | 3/1929 | Bishop . | |
| 1,719,508 | 7/1929 | Good . | |
| 1,748,728 | 2/1930 | Putnam . | |
| 1,753,745 | 4/1930 | Goby . | |
| 1,764,255 | 6/1930 | Fry . | |
| 1,791,414 | 2/1931 | Kamper . | |
| 1,818,527 | 8/1931 | Becker . | |
| 1,890,976 | 12/1932 | Erickson . | |
| 1,899,130 | 2/1933 | Barkeij . | |
| 1,954,564 | 4/1934 | Edwards et al. | 123/188.4 |
| 2,017,198 | 10/1935 | Anglada et al. . | |
| 2,080,126 | 5/1937 | Gibson et al. . | |
| 2,156,548 | 5/1939 | Smith . | |
| 2,216,953 | 10/1940 | Maxwell . | |
| 2,270,051 | 1/1942 | Hall . | |
| 2,300,025 | 10/1942 | Tomkins | 123/188.4 |
| 2,383,136 | 8/1945 | Laurain . | |
| 2,401,932 | 6/1946 | Heintz . | |
| 2,427,270 | 9/1947 | Frank et al. . | |
| 2,937,631 | 5/1960 | Coyle . | |
| 3,025,840 | 3/1962 | Casini . | |

(List continued on next page.)

FOREIGN PATENT DOCUMENTS

| | | | |
|---|---|---|---|
| 531829 | 1/1922 | France | 123/188.4 |
| 9167 | 6/1884 | United Kingdom | 123/188.4 |

*Primary Examiner*—John Kwon
*Attorney, Agent, or Firm*—Kenyon & Kenyon

[57] ABSTRACT

An internal combustion design which allows for enhanced control of the fuel-air mixture and complete exhaust of combustion gases during the exhaust stroke. The internal combustion engine does not require that the combustion gas outlet valve enter into the cylinder to allow combustion gases to exit the cylinder. The valving structure includes one or more ring valves which form the upper circumferential wall of the cylinder. The ring valve or valves can either reciprocate or rotate. The engine includes a variable-length piston rod manufactured in two parts, which parts can reciprocate relative to one another along their length. A spring—either mechanical or pressure-operated—or the inertial masses of the parts, may be used between the piston rod parts to control the reciprocation of the parts relative to one another. During the compression stroke of the piston, the piston rod parts are retracted relative to one another, so that at the top of the compression stroke the piston head does not reach the top of the cylinder, thereby creating a combustion chamber in the cylinder. During the exhaust stroke of the engine, the piston rod parts are extended relative to one another, so that at the top of the exhaust stroke the piston head reaches the top of the cylinder, eliminating the combustion chamber, thereby completely exhausting all combustion gases from the interior of the cylinder.

12 Claims, 12 Drawing Sheets

U.S. PATENT DOCUMENTS 3,603,299 9/1971 Lamperti et al. .
3,603,331 9/1971 Tanner .
3,730,161 5/1973 Deane .
3,971,355 7/1976 Kottmann .
4,098,238 7/1978 Vallejos .
4,111,164 9/1978 Wuerfel .
4,159,704 7/1979 Wiknich .
4,311,119 1/1982 Menzies et al. .
4,373,476 2/1983 Vervoordt et al. .
4,418,658 12/1983 DiRoss .
4,765,287 8/1988 Taylor et al. .
4,821,692 4/1989 Browne .
4,834,038 5/1989 Montagni .
4,838,220 6/1989 Parsons .
4,864,984 9/1989 Blish .
4,867,117 9/1989 Scalise .
4,944,261 7/1990 Coates .
4,953,527 9/1990 Coates .
4,989,558 2/1991 Coates .
5,076,219 12/1991 Pellerin .
5,109,814 5/1992 Coates .
5,245,962 9/1993 Routery .
5,257,601 11/1993 Coffin .
5,261,359 11/1993 Hull .
5,361,739 11/1994 Coates .
5,367,989 11/1994 Peyer ..... 123/188.5
5,474,036 12/1995 Hansen et al. .
5,482,011 1/1996 Falck .

INTERNAL COMBUSTION ENGINE WITH IMPROVED COMBUSTION

BACKGROUND OF THE INVENTION

1. Field of the Invention

The present invention relates to the field of internal combustion engines. In particular, the present invention relates to an internal combustion engine which achieves improved combustion through the use of improved valving systems, together with an improved piston design.

2. Description of the Prior Art

Internal combustion engines are well known in the art. Generally, such prior art internal combustion engines include one or more valves in the cylinder head of each piston-cylinder combination. Conventionally, the valves are poppet valves. These poppet valves reciprocally move from an open position—to either inlet fuel and air or outlet combustion gases—to a closed position—to seal the cylinder and allow for compression and ignition.

Conventional internal combustion engines of the prior art include a number of disadvantages which reduce their efficiency and cost-effectiveness. For example, most conventional internal combustion engines include reciprocal poppet valves in the cylinder head. Reciprocal poppet valves have a limited travel distance because the valve head must move into the interior of the cylinder. The movement is limited because of the need to prevent interference with the movement of the piston in the cylinder. As a result of the limited movement of the valve head within the cylinder, the entrance area of a fuel-air mixture, or the exhaust area of combustion gases, may be limited. This limit on the area of flow of a fuel-air mixture or combustion gases can have a detrimental effect on the fuel-air ratio in the combustion chamber during the compression stroke, and therefore can reduce the overall efficiency of operation of the engine.

Solutions have been proposed for improving the fuel-air ratio in the combustion chambers of an internal combustion engines. Such solutions, however, have not been completely satisfactory because they result in complex engine designs requiring complex maintenance, thereby increasing the costs of manufacturing and maintaining the internal combustion engine.

SUMMARY OF THE INVENTION

The present invention relates to an improved internal combustion design which allows for enhanced control of the fuel-air mixture, and which allows for complete exhaust of combustion gases during the exhaust stroke. The present invention achieves these desired results without the need for a complex and difficult-to-maintain engine design which would increase the costs of making and operating the engine.

The present invention achieves improved performance through the cooperation of several different features. The present invention includes an improved valving structure which does not require that the valve enter into the cylinder to allow combustion gases to exit the cylinder. The valving structure includes one or more ring valves which form the upper circumferential wall of the cylinder. The ring valve or valves can either reciprocate or rotate to allow fuel and air to enter the cylinder and/or combustion gases to exit the cylinder. The movement of the valve or valves to the open position does not cause the entrance of any part of the valve or valves into the cylinder, because the valve or valves move along the circumference of the cylinder wall. The design of the valves is such that the area of entrance or exit through the valves extends across a large area of the cylinder wall. As a result, the area of entrance or exhaust created by the valve opening is greatly increased, thereby improving the overall performance of the engine. In addition, the fact that the valve does not need to enter the cylinder during the exhaust stroke prevents the valve from interfering with the piston head as it exhausts combustion gases from the cylinder during the exhaust stroke.

In addition to an improved valving structure, the engine of the present invention includes an improved piston rod design. The piston of the present invention is a variable-length piston, and preferably uses a variable-length piston rod. The variable-length piston rod of the present invention is achieved by manufacturing the piston rod in two parts, which parts can reciprocate relative to one another along their length. A spring—either mechanical or pressure-operated—or the inertial masses of the parts may be used between the piston rod parts to control the reciprocation of the parts relative to one another. During the compression stroke of the piston, the piston rod parts are retracted relative to one another, so that at the top of the compression stroke the piston head does not reach the top of the cylinder, thereby creating a combustion chamber in the cylinder. During the exhaust stroke of the engine, the piston rod parts are extended relative to one another, so that at the top of the exhaust stroke the piston head reaches the top of the cylinder, eliminating the combustion chamber, and thereby completely exhausting all combustion gases from the interior of the cylinder. In this way, no residual combustion gases are left in the cylinder during the subsequent intake stroke to detrimentally effect the fuel-air mixture in the subsequent combustion.

The present invention contemplates a number of different variations for both the valve structure used and the variable-length piston.

DETAILED DESCRIPTION OF THE INVENTION

Figure 1A:
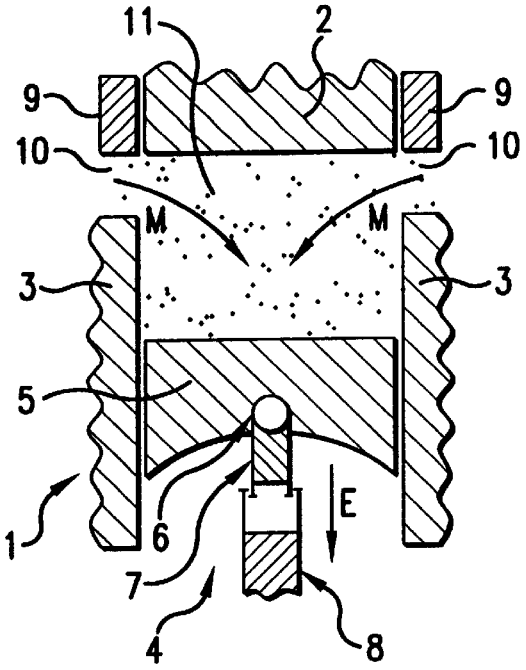
FIGS. 1*a*–1*h* show, schematically, the sequence of operation of the present invention.

FIGS. 1*a*–1*h* show, schematically, the sequence of operation of a piston and cylinder of the internal combustion engine of the present invention. The invention includes a cylinder 1 having a cylinder head 2 and a cylindrical side wall 3. Slidably received within cylinder 1 is a piston 4. Piston 4 includes a piston head 5 connected via, e.g., pivot connection 6 to an upper part 7 of a piston rod. Upper part 7 is connected for reciprocal movement to lower part 8 of piston rod. At the closed end of cylinder 1 is located a valve 9 with a circumferential inner wall flush with the circumferential inner wall of the cylinder cylindrical side wall 3, thereby forming the upper circumferential wall of the cylinder 1. As will be discussed in greater detail below, valve 9 can take a number of different forms, and can be the fuel-air inlet valve and/or the combustion gas outlet valve. FIGS. 1*a*–1*h* are not intended to show details of the valve 9, but merely show the sequence of operation of the piston 4 and cylinder 1 relative to valve operation.

FIG. 1*a* shows the present invention partially through the intake stroke. In the condition of FIG. 1*a*, the valve 9 has been placed in a fuel-air mixture inlet position, thereby establishing communication between the interior 11 of cylinder 1 and valve opening 10, so that a fuel-air mixture may pass into the interior 11 of cylinder 1. In the condition of FIG. 1*a*, the piston 4 is being pulled away from cylinder head 2 in an expansion direction E, thereby increasing the volume of the interior 11 of cylinder 1 and drawing a fuel-air mixture into interior 11. The path of fuel-air mixture into interior 11 is represented by arrows M. In the condition of FIG. 1*a*, the upper part 7 of the piston rod is in an extended position relative to the lower part 8 of the piston rod. The piston rod is used to pull the piston 4 in the expansion direction E.

Figure 1B:
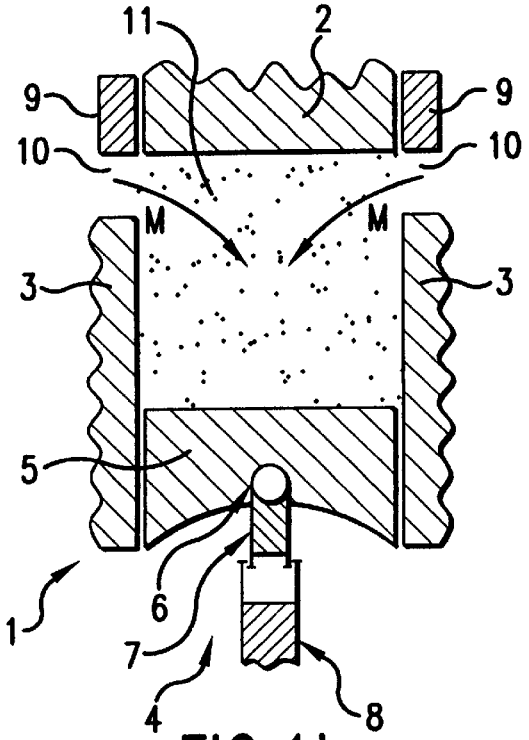
Figure 1C:
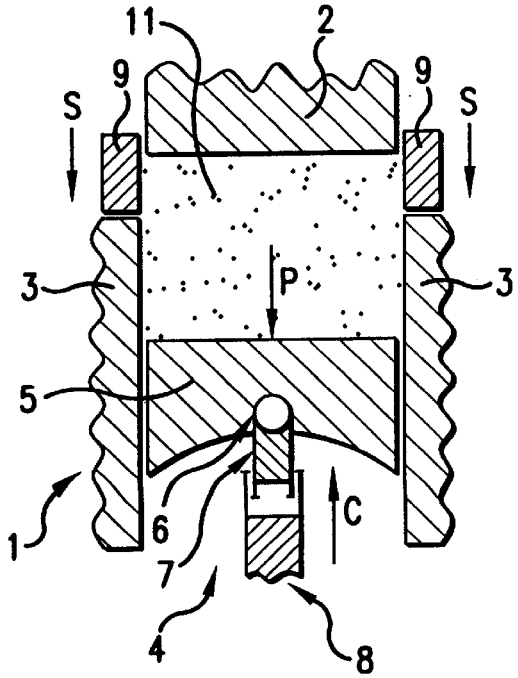

FIG. 1*b* shows the bottom dead center position of piston 4 in cylinder 1 during transition between the expansion stroke and the compression stroke. Immediately after piston 4 reaches the bottom dead center position of FIG. 1*b*, the valve 9 is actuated into a closed position (FIGS. 1*c*–1*f*) by moving valve 9 in a closing or shutting direction S. FIG. 1*c* shows the present invention partially through the compression stroke. In the condition of FIG. 1*c*, valve 9 is closed, and the piston rod pushes the piston 4 toward the cylinder head 2 in a compression direction C. Because the valve 9 is closed, the fuel-air mixture in interior 11 is compressed as the piston 4 moves in compression direction C, resulting in a pressure force P acting against piston 4. This pressure force P causes the upper part 7 of the piston rod to retract relative to the lower part 8 of the piston rod.

Figure 1D:
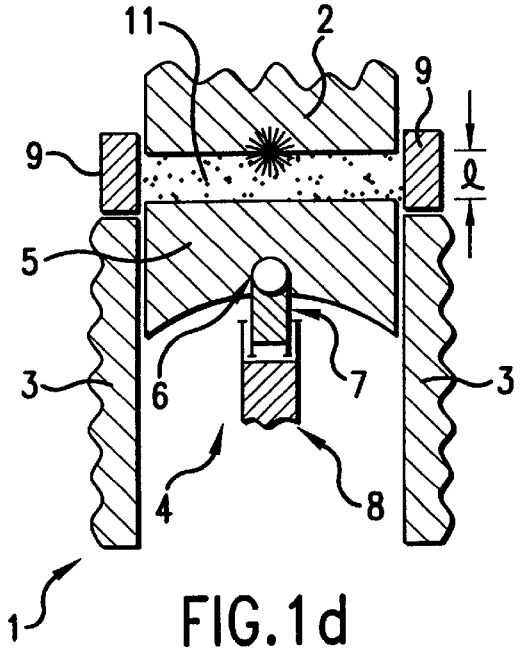

FIG. 1*d* shows the present invention in the top dead center position between the compression stroke and the power stroke. In this position, the upper part 7 of the piston rod is fully retracted relative to the lower part 8 of the piston rod, resulting in a combustion chamber of a length l between the piston head 5 and the cylinder head 2. The fuel-air mixture in the combustion chamber is in a compressed state, and in the top dead center position of FIG. 1*d*, this mixture is ignited. Ignition of the fuel-air mixture in the top dead center position of FIG. 1*d* can be accomplished, in an Otto cycle engine, by a suitable spark-producing device such as a spark plug, or in a Diesel cycle engine, by the compression of the mixture itself.

Figure 1E:
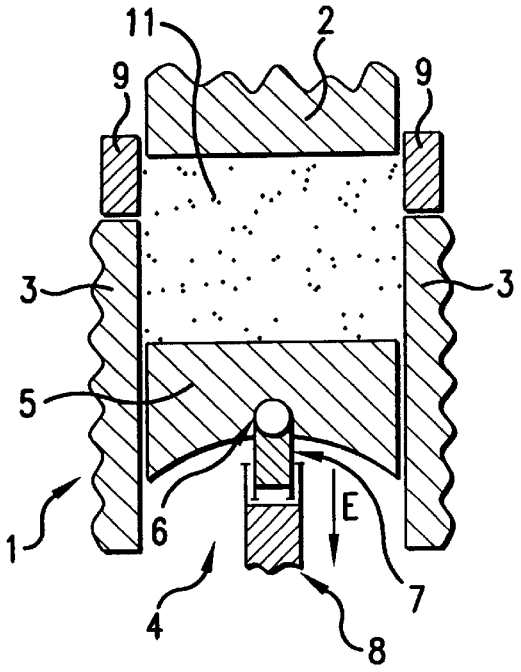
Figure 1F:
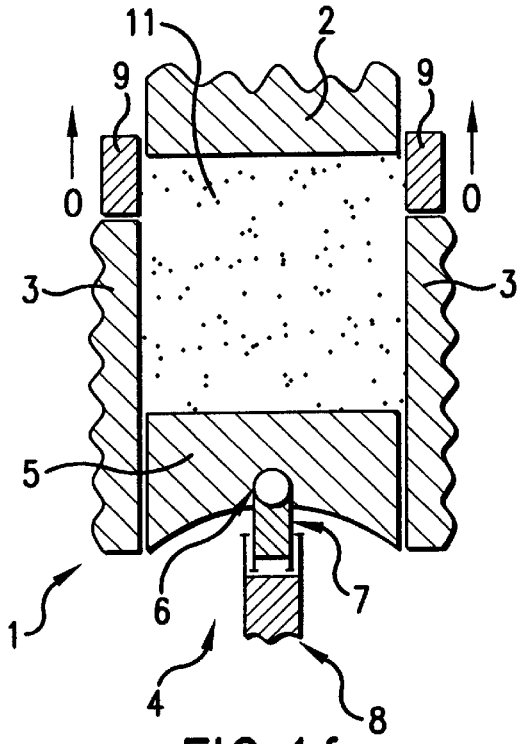
Figure 1G:
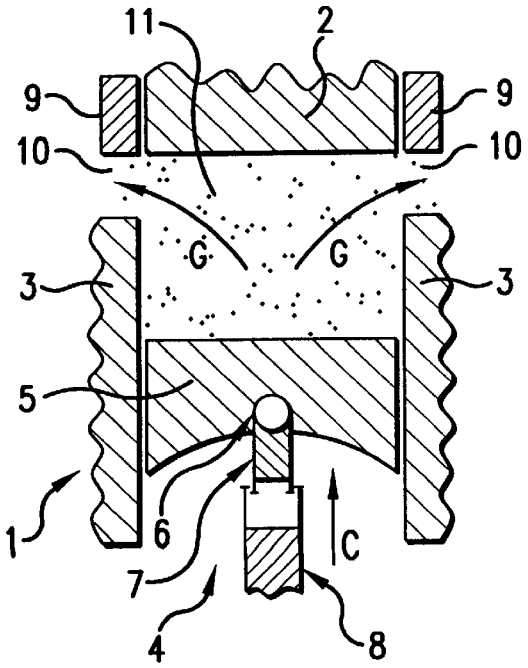
Figure 1H:
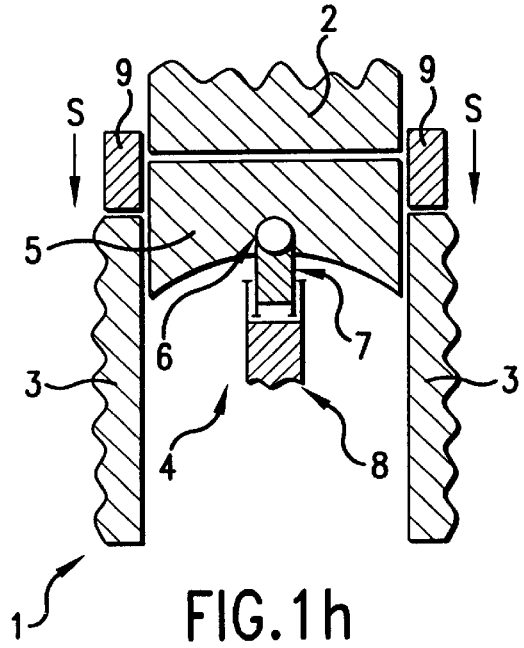

FIG. 1*e* shows the present invention partially through the power stroke. Piston 4 is forced in expansion direction E by the expansion of combustion gases in the interior 11, thereby pushing down the piston rod. The piston 4 is forced by the expanding expansion gases to the bottom dead center position between the power stroke and the exhaust stroke, shown in FIG. 1*f*. Immediately after the piston 4 reaches the bottom dead center position between the power stroke and the exhaust stroke, the valve 9 is moved in an opening direction O. Piston 4 thereafter is pushed in the compression direction C, forcing the combustion gases in the interior 11 out through valve opening 10 in the direction indicated by arrows G. FIG. 1*g* shows the present invention partially through the exhaust stroke. Because the combustion gases in interior 11 exhaust through valve opening 10, no pressure is created in interior 11, and the upper part 7 of the piston rod is extended relative to the lower part 8 of the piston rod. FIG. 1*h* shows the present invention in the top dead center position between the exhaust stroke and the intake stroke. Because the upper part 7 of the piston rod is in the fully extended position relative to the lower part 8 of the piston rod, the piston head 5 is contiguous with and meets the cylinder head 4, thereby leaving no volume between the piston head 5 and the cylinder head 4 and eliminating the combustion chamber. As a result, all combustion gases are fully exhausted from the interior 11 immediately prior to inlet of the fuel-air mixture into the cylinder 1 because the piston head 5 fully displaces the complete volume of the cylinder 1 interior 11. The cycle of FIGS. 1*a*–1*h* is thereafter repeated.

Figure 2:
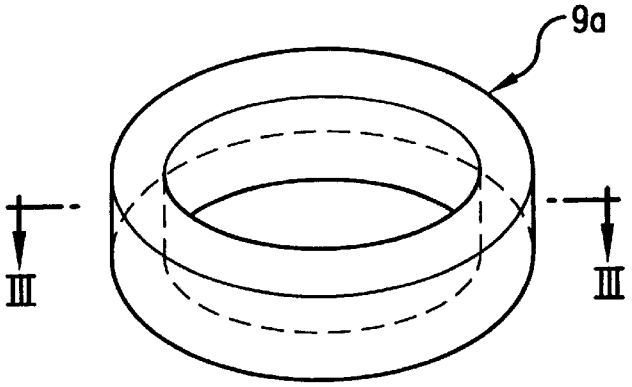
FIG. 2 is a perspective view of a first embodiment of a valve of the present invention.
Figure 3:
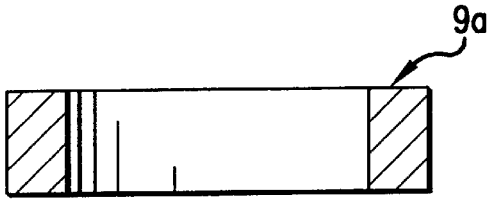
FIG. 3 is a cross-sectional view of the valve of FIG. 2.

FIGS. 2 and 3 show a first embodiment of a valve 9*a* of the present invention. The embodiment of FIGS. 2 and 3 is a non-apertured reciprocating ring valve 9*a*, which in a preferred embodiment is in the form of a rectangular cross-sectioned toroid.

Figure 4:
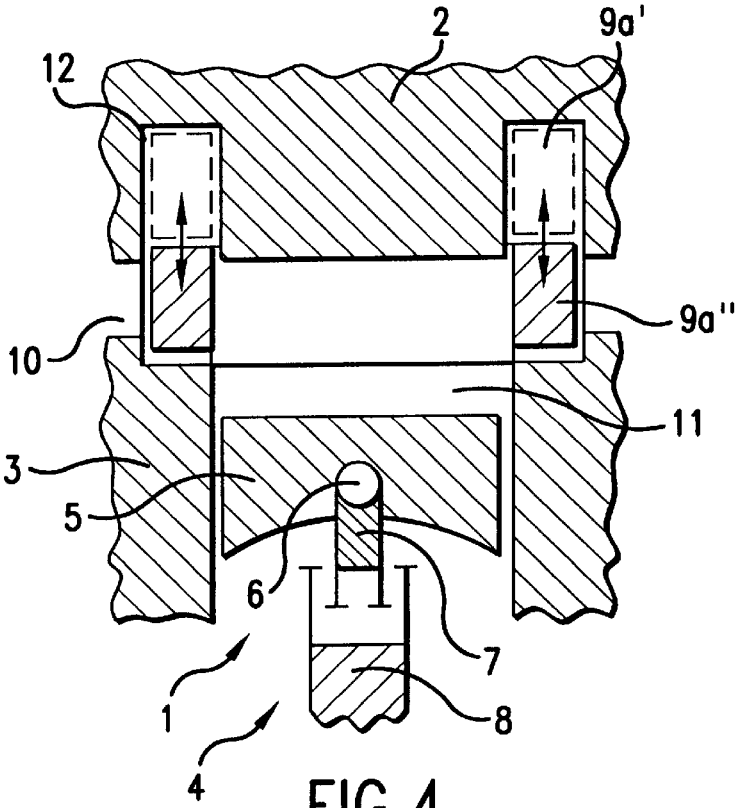
FIG. 4 is a schematic representation of the operation of the valve of FIG. 2.

FIG. 4 shows schematically the operation of the valve 9*a* of FIGS. 2 and 3. Valve 9*a* is contained within a valve groove 12 in cylinder 1. In the closed position 9*a*" of the valve 9*a*, the valve 9*a* is extended away from the cylinder head 2 until it closes off valve opening 10 from interior 11. In the open position 9*a*' (dotted lines, FIG. 4) of the valve 9*a*, the valve 9*a* is retracted into valve groove 12 in cylinder head 2 so that valve opening 10 communicates with interior 11. The movement of valve 9*a* is indicated by the double-headed arrow in FIG. 4, and may be accomplished by any known mechanism for producing such reciprocal motion.

Figure 5:
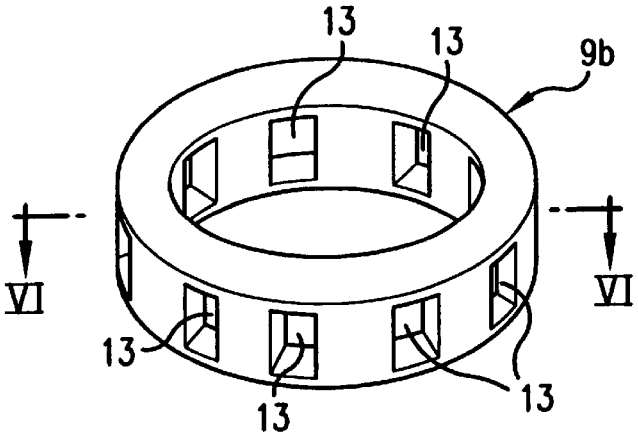
FIG. 5 is a perspective view of a second embodiment of a valve of the present invention.
Figure 6:
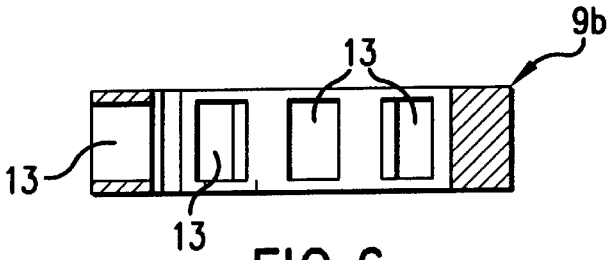
FIG. 6 is a cross-sectional view of the valve of FIG. 5.

FIGS. 5 and 6 show a second embodiment of a valve 9*b* of the present invention. The embodiment of FIGS. 5 and 6 is an apertured rotating ring valve 9*b*, which in a preferred embodiment is in the form of a rectangular cross-sectioned toroid with a series of apertures 13 spaced around the circumference.

Figure 7:
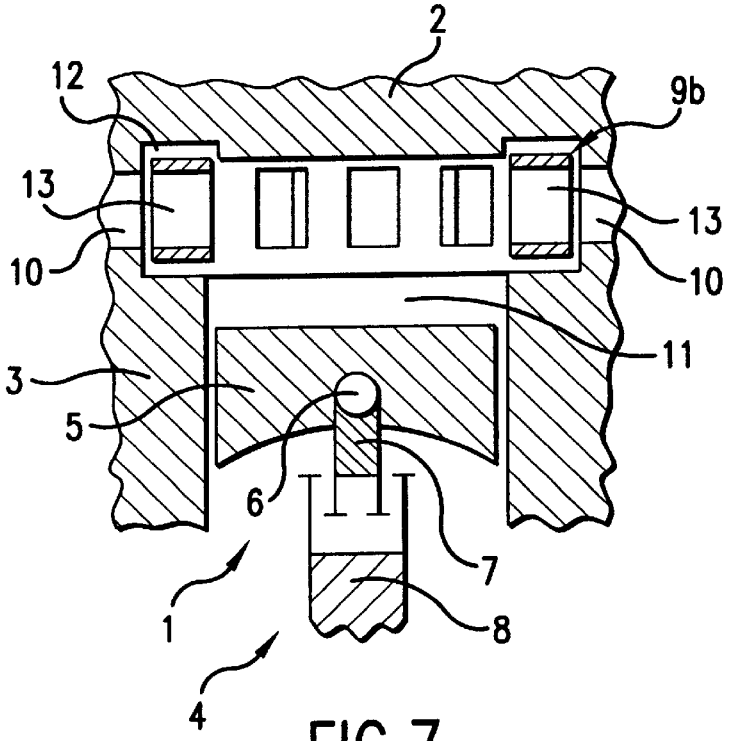
FIG. 7 is a schematic representation of the operation of the valve of FIG. 5.

FIG. 7 shows schematically the operation of the valve 9*b* of FIGS. 5 and 6. Valve 9*b* is contained within a valve groove 12 in cylinder 1. In the closed position of the valve 9*b* (not shown in FIG. 7), the valve 9*b* is rotated in valve groove 12 to a position in which apertures 13 are not aligned with valve openings 10 circumferentially spaced around cylinder 1, thereby closing off valve openings 10 from interior 11. In the open position (shown in FIG. 7) of the valve 9*b*, the valve 9*b* is rotated into a position in which apertures 13 are aligned with the valve openings 10 circumferentially spaced around cylinder 1, so that valve openings 10 communicate with interior 11. The movement of valve 9*b* may be accomplished by any known mechanism for producing such rotary motion.

Figure 8:
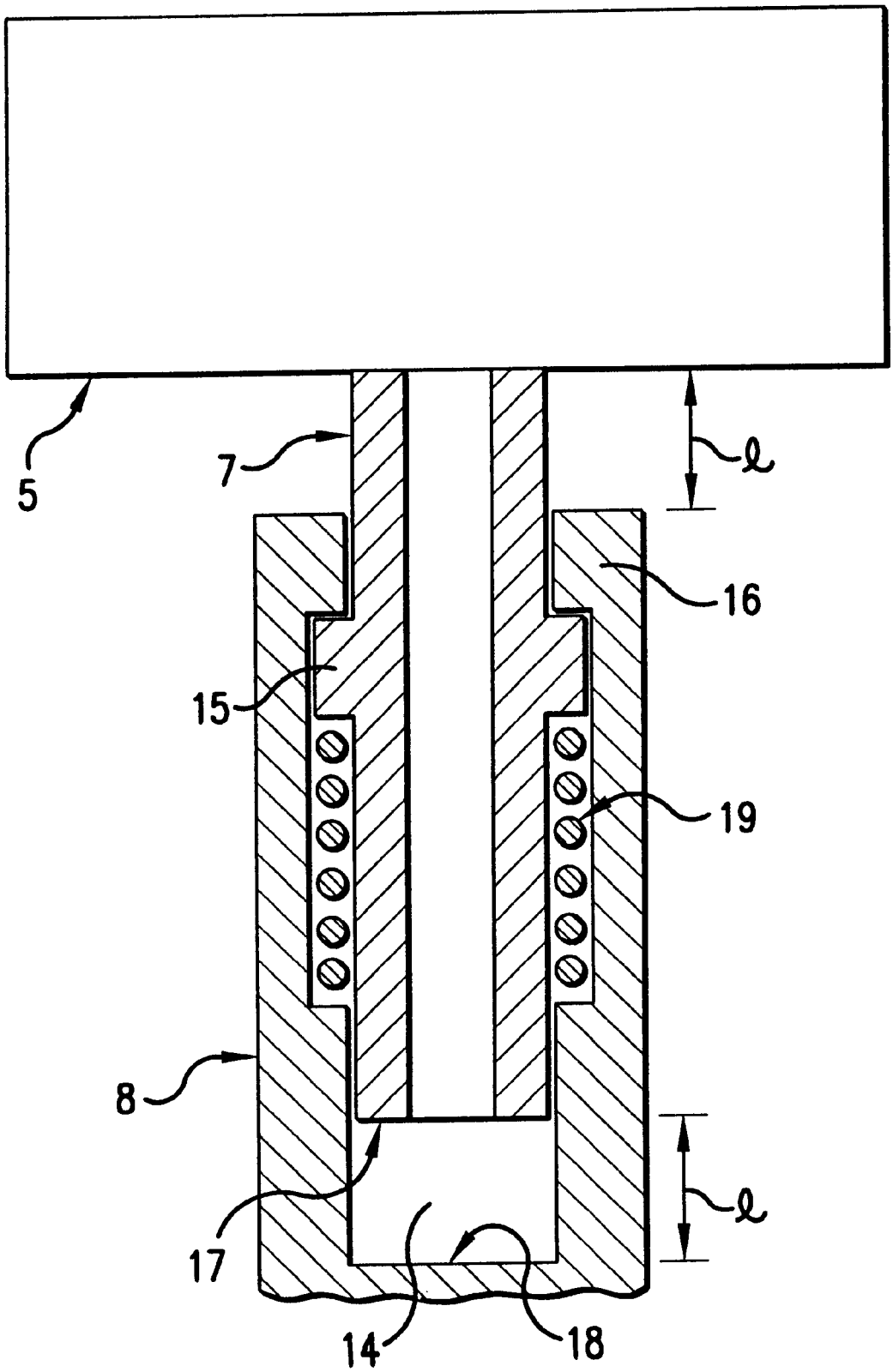
FIG. 8 is a schematic cross-sectional view of the piston rod of the present invention.

FIG. 8 is a schematic cross-sectional view of an embodiment of the piston rod of the present invention. The piston rod includes an upper part 7 and a lower part 8. Upper part 7 and lower part 8 are mounted for relative reciprocal movement. Lower part 8 includes a clearance space 14 which allows for relative reciprocal movement between upper 7 and lower 8 parts. Upper part 7 includes a retention flange 15 which cooperates with a retention flange 16 on lower part to restrain the relative extension between upper 7 and lower 8 parts. Similarly, cooperation between piston head 5 and retention flange 16, or cooperation between the lower end 17 of upper part 7 and the lower part 18 of clearance space 14, restrains the relative retraction between upper 7 and lower 8 parts. The relative movement between upper part 7 and lower part 8 is therefore restrained to a distance l equal to the length of the combustion chamber. A compression spring 19 between upper part 7 and lower part 8 may be used to bias upper part 7 to an extended position relative to lower part 8. In this way, the piston rod will normally be in the extended position (shown in FIG. 8), unless acted upon by pressure forces within cylinder interior 11 or inertial forces. As a result, only during the compression and power strokes is the piston rod retracted, and therefore only during those strokes is the combustion chamber of length l created. As an alternative to use of the helical spring 19 shown in FIG. 8, a hydraulic or pneumatic spring could be created between upper 7 and lower 8 parts, or the inertia of the upper part 7 and piston head 5 could be used to produce the same effect.

Figure 9:
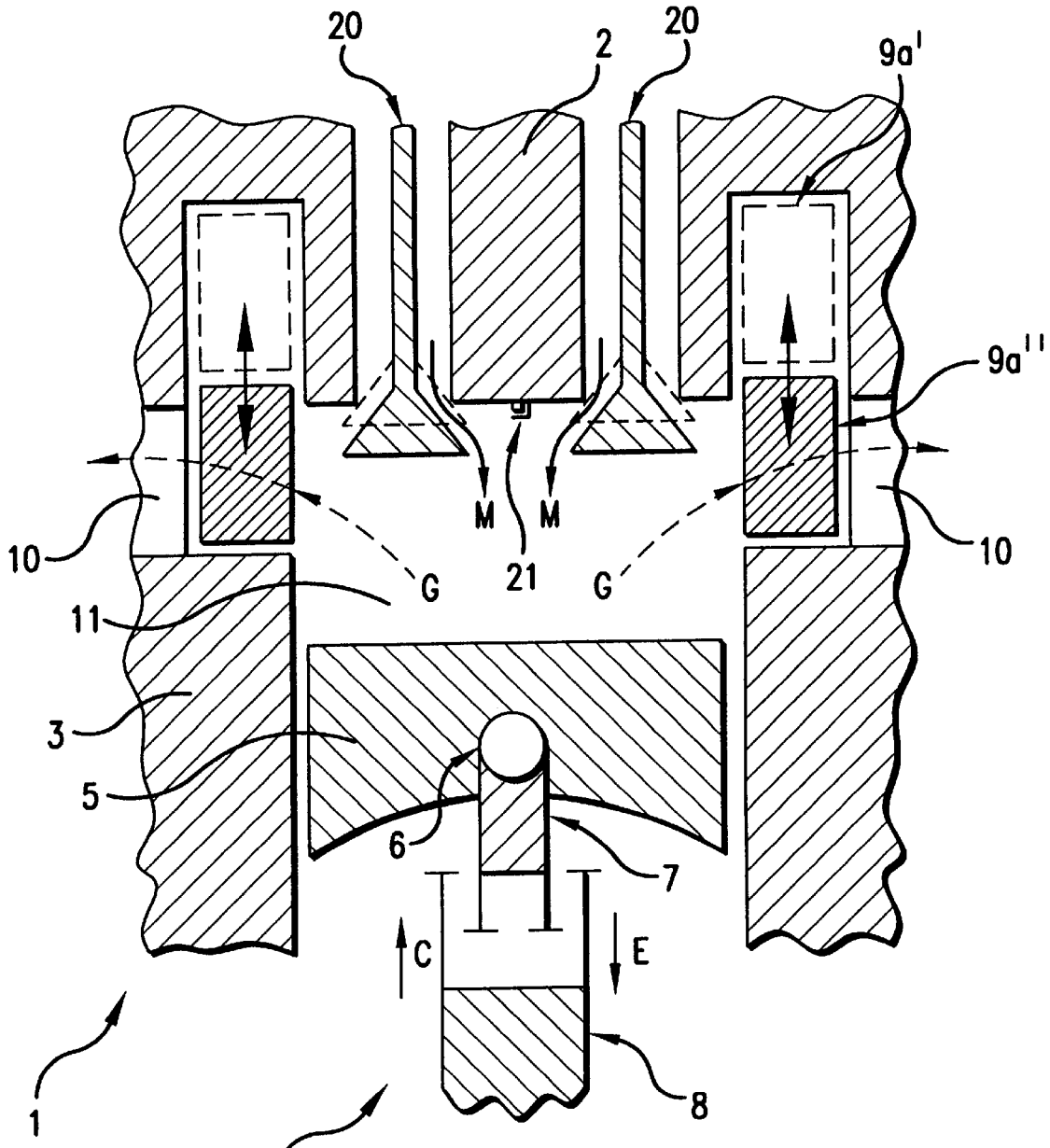
FIG. 9 is a schematic cross-sectional view of a first embodiment of the present invention.

FIG. 9 is a schematic cross-sectional view of a first embodiment of the present invention. In the embodiment of FIG. 9, the fuel-air intake valves 20 are conventional poppet valves, while the combustion gas exhaust valve 9*a* is a non-apertured reciprocating valve of the type shown in FIGS. 2–3. The embodiment shown in FIG. 9 is an Otto cycle engine which includes a spark plug 21. During the expansion stroke, the piston 4 moves in the expansion direction E, the poppet valves 20 are in their open position (solid lines, FIG. 9), the combustion gas exhaust valve 9*a* is in its closed position 9*a*", and the piston rod upper 7 and lower 8 parts are in their extended position. As a result, the fuel-air mixture is drawn into interior 11 along paths M. During the compression stroke, the piston 4 moves in the compression direction C, the poppet valves 20 are in their closed position (dotted lines, FIG. 9), the combustion gas exhaust valve 9*a* is in its closed position 9*a*", and the piston rod upper 7 and lower 8 parts are in their retracted position. As a result, the fuel-air mixture is compressed in interior 11 while the combustion chamber of length l is created at the top dead center position. The fuel-air mixture is thereafter ignited by spark plug 21. During the power stroke, the piston 4 moves in the expansion direction E, the poppet valves 20 remain in their closed position, the combustion gas exhaust valve 9*a* remains in its closed position 9*a*", and the piston rod upper 7 and lower 8 parts are in their retracted position. The combustion gases expand in interior 11, thereby forcing the piston rod down and providing power to the engine. Finally, during the exhaust stroke, the piston 4 moves in the compression direction C, the poppet valves 20 remain in their closed position, the combustion gas exhaust valve 9*a* is moved to its open position 9*a*' (dotted lines, FIG. 9), and the piston rod upper 7 and lower 8 parts are in their extended position. As a result, the combustion gases are forced out of interior 11, through valve openings 10, along paths G. No combustion chamber exists during the exhaust stroke because the piston rod is in its extended position and has extended the full distance l corresponding to the length of the combustion chamber. Because the combustion gas exhaust valve 9*a* does not extend into the interior 11, because the poppet valves 20 in their closed position are flush with the cylinder head 2, and because the piston rod upper 7 and lower 8 parts are in their extended position during the exhaust stroke, the piston head 5 meets and is contiguous with the cylinder head 2 in the top dead center position between the exhaust and inlet strokes, exhausting all of the expansion gases from interior 11.

Figure 10A:
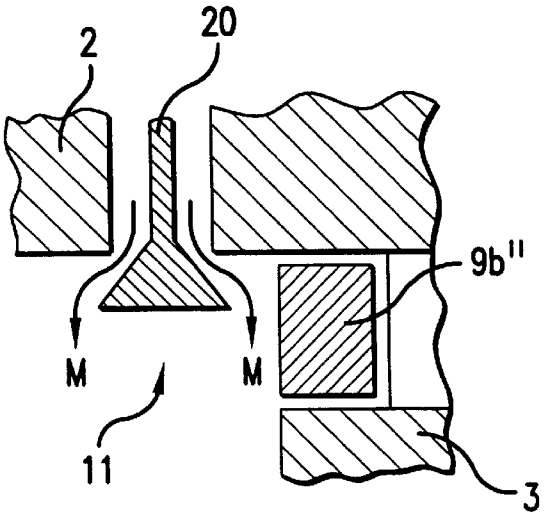
FIG. 10*a* is a partial schematic cross-sectional view of the embodiment of FIG. 10.
Figure 10:
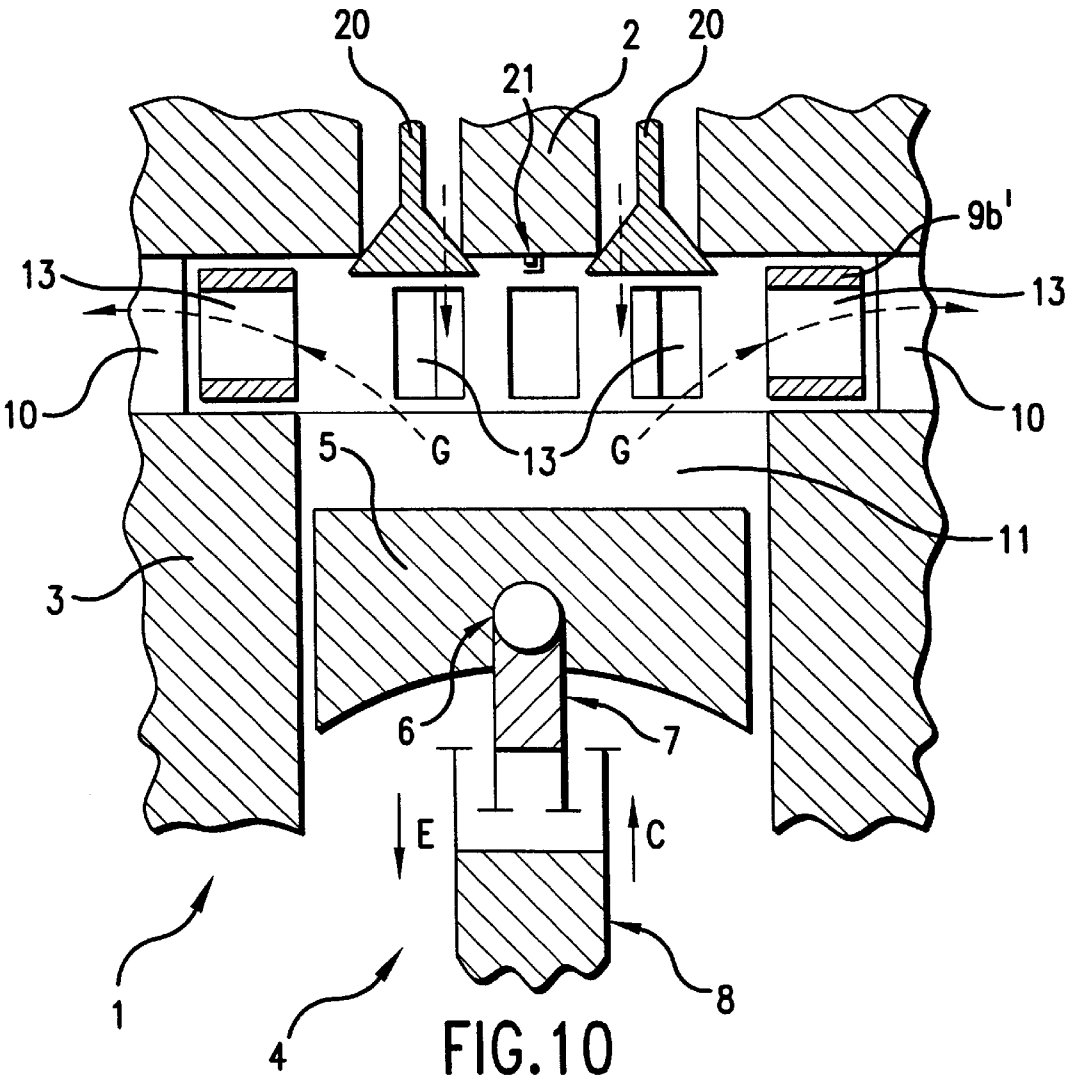
FIG. 10 is a schematic cross-sectional view of a second embodiment of the present invention.

FIGS. 10 and 10*a* are schematic cross-sectional views of a second embodiment of the present invention. In the embodiment of FIGS. 10 and 10*a*, the fuel-air intake valves 20 are conventional poppet valves, while the combustion gas exhaust valve 9*b* is an apertured rotating valve of the type shown in FIGS. 5–6. The embodiment shown in FIGS. 10 and 10*a* is an Otto cycle engine which includes a spark plug 21. During the expansion stroke, the piston 4 moves in the expansion direction E, the poppet valves 20 are in their open position (FIG. 10*a*), the combustion gas exhaust valve 9*b* is in its closed position 9*b*" (FIG. 10*a*), and the piston rod upper 7 and lower 8 parts are in their extended position. As a result, the fuel-air mixture is drawn into interior 11 along paths M. During the compression stroke, the piston 4 moves in the compression direction C, the poppet valves 20 remain in their closed position, the combustion gas exhaust valve 9*b* remains in its closed position 9*b*", and the piston rod upper 7 and lower 8 parts are in their retracted position. As a result, the fuel-air mixture is compressed in interior 11 while the combustion chamber of length l is created at the top dead center position. The fuel-air mixture is thereafter ignited by spark plug 21. During the power stroke, the piston 4 moves in the expansion direction E, the poppet valves 20 remain in their closed position, the combustion gas exhaust valve 9*b* remains in its closed position 9*b*", and the piston rod upper 7 and lower 8 parts are in their retracted position. The combustion gases expand in interior 11, thereby forcing the piston rod down and providing power to the engine. Finally, during the exhaust stroke, the piston 4 moves in the compression direction C, the poppet valves 20 remain in their closed position, the combustion gas exhaust valve 9*b* is rotated to its open position 9*b*' (FIG. 10), and the piston rod upper 7 and lower 8 parts are in their extended position. As a result, the combustion gases are forced out of interior 11, through apertures 13 and valve openings 10, along paths G. No combustion chamber exists during the exhaust stroke because the piston rod is in its extended position and has extended the full distance e corresponding to the length of the combustion chamber. Because the combustion gas exhaust valve 9*b* does not extend into the interior 11, because the poppet valves 20 in their closed position are flush with the cylinder head 2, and because the piston rod upper 7 and lower 8 parts are in their extended position during the exhaust stroke, the piston head 5 meets and is contiguous with the cylinder head 2 in the top dead center position between the exhaust and inlet strokes, exhausting all of the expansion gases from interior 11.

Figure 11:
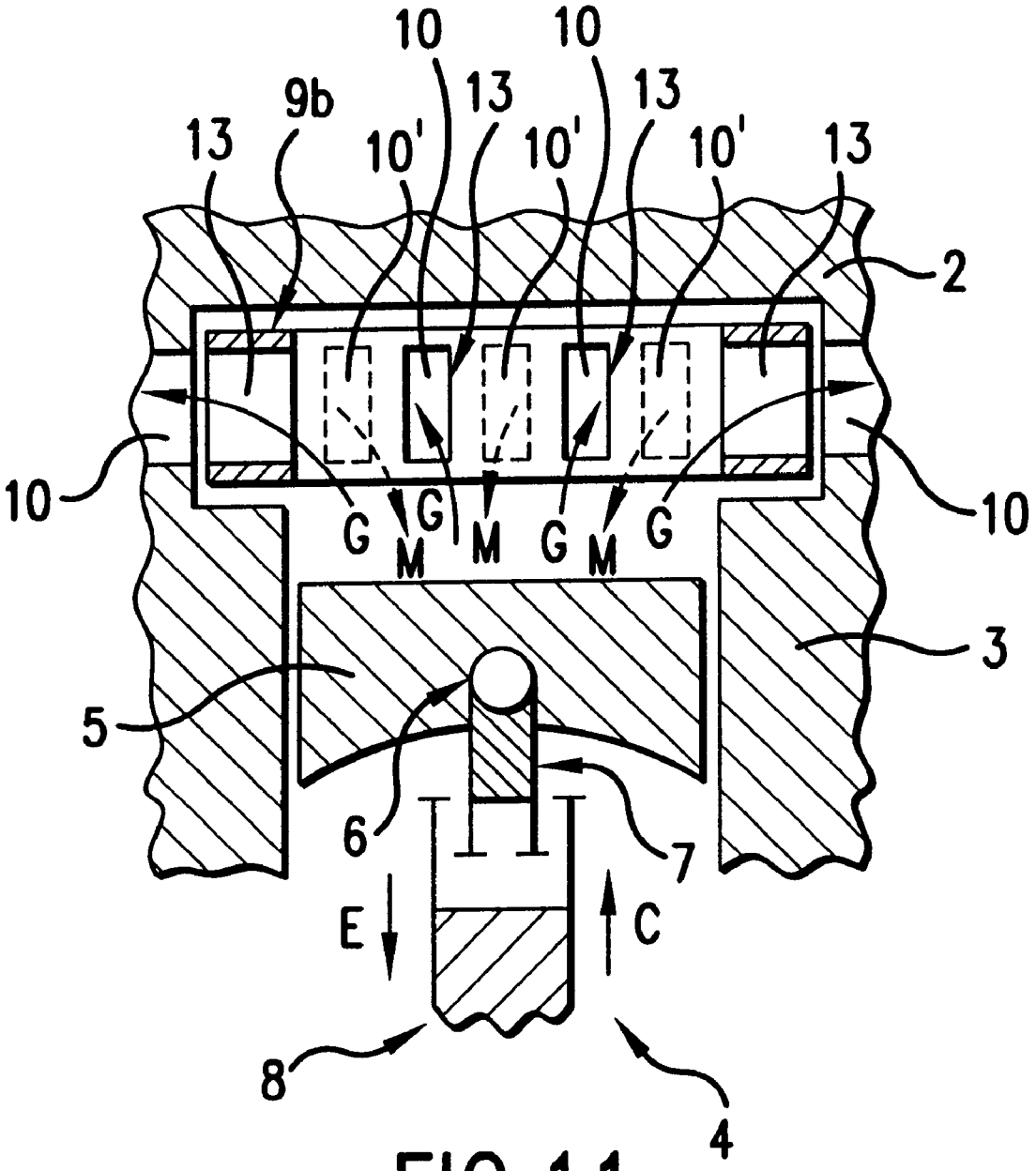
FIG. 11 is a schematic cross-sectional view of a third embodiment of the present invention.

FIG. 11 is a schematic cross-sectional view of a third embodiment of the present invention. In the embodiment of FIG. 11, the fuel-air intake valve and the combustion gas exhaust valve are combined into a single apertured rotating valve 9*b* of the type shown in FIGS. 5–6. In the embodiment of FIG. 11, the cylindrical side wall 3 contains, at its closed end, an alternating series of radial combustion gas exhaust openings 10 and fuel-air mixture inlet openings 10'. During the expansion stroke, the piston 4 moves in the expansion direction E, the valve 9*b* is rotated into a position in which apertures 13 are aligned with fuel-air mixture inlet openings 10' (and thereby the remainder of valve 9*b* closes off combustion gas exhaust openings 10), and the piston rod upper 7 and lower 8 parts are in their extended position. As a result, the fuel-air mixture is drawn into interior 11 along paths M, through fuel-air mixture inlet openings 10' and apertures 13. During the compression stroke, the piston 4 moves in the compression direction C, the valve 9*b* is rotated into a position in which apertures 13 are aligned with neither fuel-air mixture inlet openings 10' or combustion gas exhaust openings 10, thereby closing off all of these openings 10, 10', and the piston rod upper 7 and lower 8 parts are in their retracted position. As a result, the fuel-air mixture is compressed in interior 11 while the combustion chamber of length l is created at the top dead center position, and the fuel-air mixture is thereafter ignited. During the power stroke, the piston 4 moves in the expansion direction E, the valve 9*b* remains in a position in which apertures 13 are aligned with neither fuel-air mixture inlet openings 10' or combustion gas exhaust openings 10, and the piston rod upper 7 and lower 8 parts are in their retracted position. The combustion gases expand in interior 11, thereby forcing the piston rod down and providing power to the engine. Finally, during the exhaust stroke, the piston 4 moves in the compression direction C, the valve 9*b* is rotated into a position in which apertures 13 are aligned with combustion gas exhaust openings 10 (and thereby the remainder of valve 9*b* closes off fuel-air mixture inlet openings 10'), and the piston rod upper 7 and lower 8 parts are in their extended position. As a result, the combustion gases are forced out of interior 11, through apertures 13 and combustion gas exhaust openings 10, along paths G. No combustion chamber exists during the exhaust stroke because the piston rod is in its extended position and has extended the full distance l corresponding to the length of the combustion chamber. Because the valve 9*b* does not extend into the interior 11, and because the piston rod upper 7 and lower 8 parts are in their extended position during the exhaust stroke, the piston head 5 meets and is contiguous with the cylinder head 2 in the top dead center position, exhausting all of the expansion gases from interior 11.

Figure 12B:
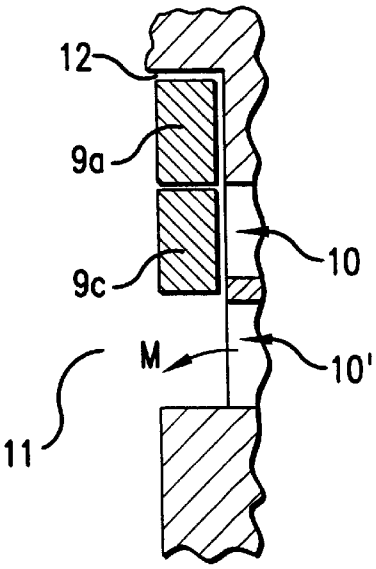
FIGS. 12*a* and 12*b* are partial schematic cross-sectional views of the embodiment of FIG. 12.
Figure 12A:
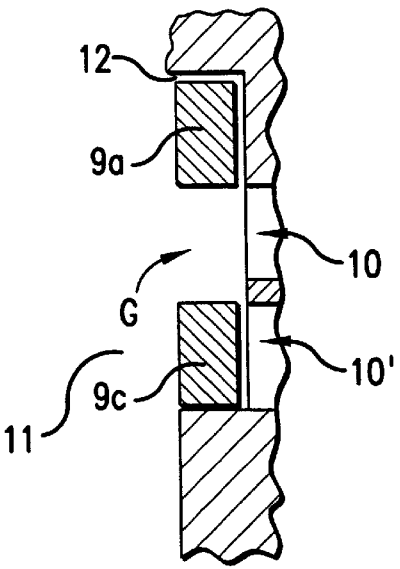
Figure 12:
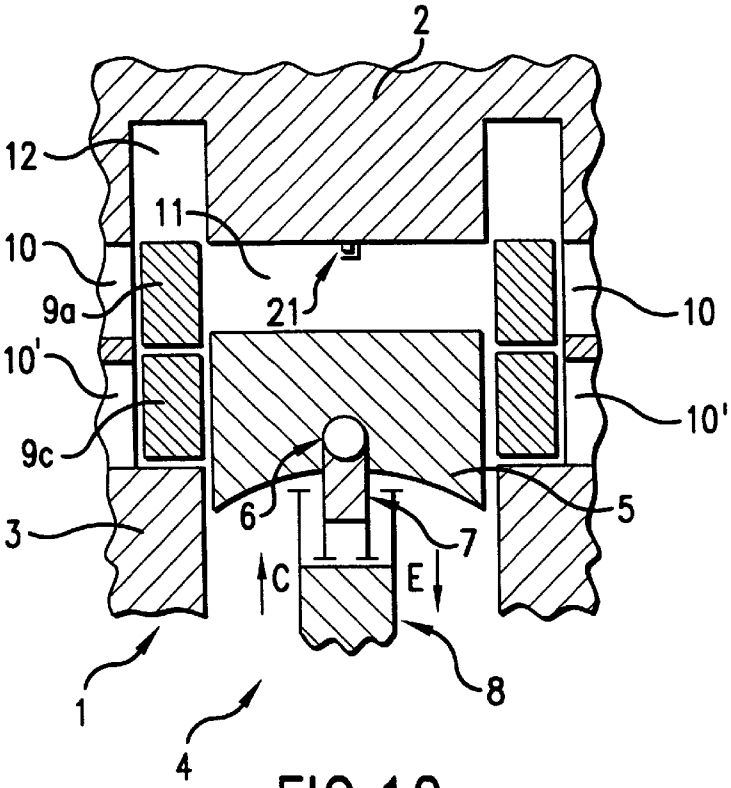
FIG. 12 is a schematic cross-sectional view of a fourth embodiment of the present invention.

FIGS. 12, 12*a* and 12*b* are schematic cross-sectional views of a fourth embodiment of the present invention. In the embodiment of FIGS. 12, 12*a* and 12*b*, the fuel-air intake valve 9*c* and combustion gas exhaust valve 9*a* are both non-apertured reciprocating valves of the type shown in FIGS. 2–3. The embodiment shown in FIGS. 12, 12*a* and 12*b* is an Otto cycle engine which includes a spark plug 21. During the expansion stroke, the piston 4 moves in the expansion direction E, the fuel-air intake valve 9*c* is open and the combustion gas exhaust valve 9*a* is closed, by retracting both valves 9*a* and 9*c* toward the cylinder head 2 (FIG. 12*b*), and the piston rod upper 7 and lower 8 parts are in their extended position. As a result, the fuel-air mixture is drawn into interior 11 through fuel-air mixture inlet opening 10' along path M. During the compression stroke, the piston 4 moves in the compression direction C, both the fuel-air intake valve 9*c* and the combustion gas exhaust valve 9*a* are closed, by extending both valves 9*a* and 9*c* away from the cylinder head 2 (FIG. 12), and the piston rod upper 7 and lower 8 parts are in their retracted position. As a result, the fuel-air mixture is compressed in interior while the combustion chamber of length l is created at the top dead center position, and the fuel-air mixture is thereafter ignited by spark plug 21. During the power stroke, the piston 4 moves in the expansion direction E, both the fuel-air intake valve 9*c* and the combustion gas exhaust valve 9*a* remain closed, and the piston rod upper 7 and lower 8 parts are in their retracted position. The combustion gases expand in interior 11, thereby forcing the piston rod down and providing power to the engine. Finally, during the exhaust stroke, the piston 4 moves in the compression direction C, the fuel-air intake valve 9*c* is closed and the combustion gas exhaust valve 9*a* is opened, by extending valve 9*a* away from the cylinder head 2 and retracting valve 9*a* toward the cylinder head 2 (FIG. 12*a*), and the piston rod upper 7 and lower 8 parts are in their extended position. As a result, the combustion gases are forced out of interior 11, through valve opening 10, along path G. No combustion chamber exists during the exhaust stroke because the piston rod is in its extended position and has extended the full distance l corresponding to the length of the combustion chamber. Because neither the fuel-air intake valve 9*c* nor the combustion gas exhaust valve 9*a* extend into the interior 11, and because the piston rod upper 7 and lower 8 parts are in their extended position during the exhaust stroke, the piston head 5 meets and is contiguous with the cylinder head 2 in the top dead center position, exhausting all of the expansion gases from interior 11.

Figure 13B:
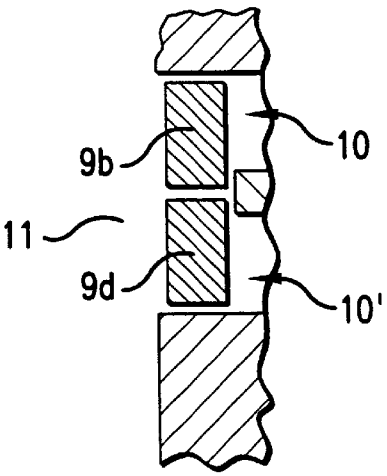
FIGS. 13*a* and 13*b* are partial schematic cross-sectional views of the embodiment of FIG. 13.
Figure 13A:
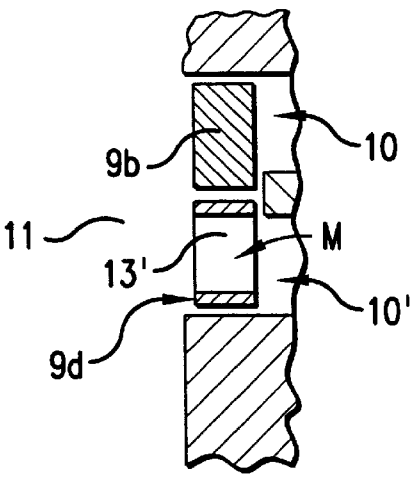
Figure 13:
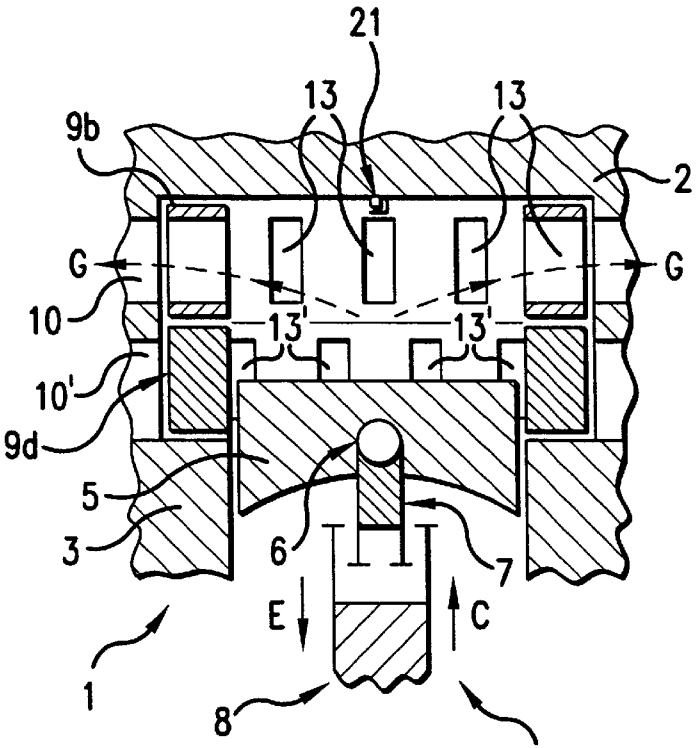
FIG. 13 is a schematic cross-sectional view of a fifth embodiment of the present invention.

FIGS. 13, 13*a* and 13*b* are schematic cross-sectional views of a fifth embodiment of the present invention. In the embodiment of FIGS. 13, 13*a* and 13*b*, the fuel-air intake valve 9*d* and combustion gas exhaust valve 9*b* are both apertured rotating valves of the type shown in FIGS. 5–6. The embodiment shown in FIGS. 13, 13*a* and 13*b* is an Otto cycle engine which includes a spark plug 21. During the expansion stroke, the piston 4 moves in the expansion direction E, the fuel-air intake valve 9*d* is open and the combustion gas exhaust valve 9*b* is closed, by rotating valve 9*d* so that apertures 13' align with fuel-air mixture inlet openings 10' and rotating valve 9*b* so that apertures 13 do not align with combustion gas exhaust outlets 10 (FIG. 13*a*), and the piston rod upper 7 and lower 8 parts are in their expanded position. As a result, the fuel-air mixture is drawn into interior 11 through fuel-air mixture inlet opening 10' along path M. During the compression stroke, the piston 4 moves in the compression direction C, both the fuel-air intake valve 9*d* and the combustion gas exhaust valve 9*b* are closed, by rotating valve 9*d* and valve 9*b* so that apertures 13, 13' do not align with combustion gas exhaust outlets 10 and fuel-air mixture inlet openings 10' (FIG. 13*b*), and the piston rod upper 7 and lower 8 parts are in their retracted position. As a result, the fuel-air mixture is compressed in interior 11 while the combustion chamber of length l is created at the top dead center position, and the fuel-air mixture is thereafter ignited by spark plug 21. During the power stroke, the piston 4 moves in the expansion direction E, both the fuel-air intake valve 9*d* and the combustion gas exhaust valve 9*b* remain closed, and the piston rod upper 7 and lower 8 parts are in their retracted position. The combustion gases expand in interior 11, thereby forcing the piston rod down and providing power to the engine. Finally, during the exhaust stroke, the piston 4 moves in the compression direction C, the fuel-air intake valve 9*d* is closed and the combustion gas exhaust valve 9*b* is opened, by rotating valve 9*d* so that apertures 13' do not align with fuel-air mixture inlet openings 10' and rotating valve 9*b* so that apertures 13 do align with combustion gas exhaust outlets 10 (FIG. 13), and the piston rod upper 7 and lower 8 parts are in their extended position. As a result, the combustion gases are forced out of interior 11, through apertures 13 and combustion gas exhaust outlets 10, along path G. No combustion chamber exists during the exhaust stroke because the piston rod is in its extended position and has extended the full distance l corresponding to the length of the combustion chamber. Because the neither the fuel-air intake valve 9*d* nor the combustion gas exhaust valve 9*b* extend into the interior 11, and because the piston rod upper 7 and lower 8 parts are in their extended position during the exhaust stroke, the piston head 5 meets and is contiguous with the cylinder head 2 in the top dead center position, exhausting all of the expansion gases from interior 11.

Figure 14:
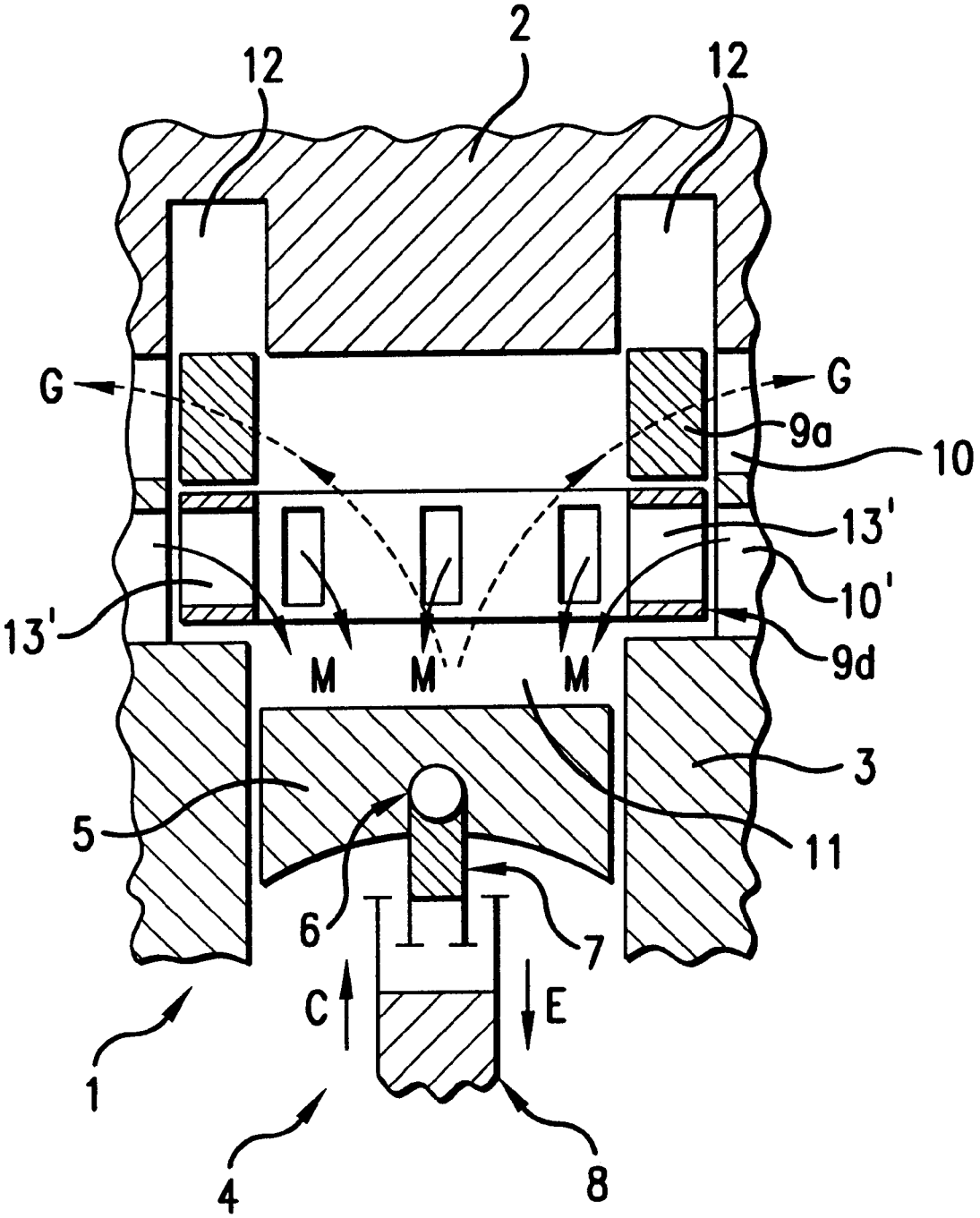
FIG. 14 is a schematic cross-sectional view of a sixth embodiment of the present invention.

FIG. 14 is a schematic cross-sectional view of a sixth embodiment of the present invention. In the embodiment of FIG. 14, the fuel-air intake valve 9*d* is an apertured rotating valve of the type shown in FIGS. 5–6, and the combustion gas exhaust valve 9*a* is a non-apertured reciprocating valve of the type shown in FIGS. 2–3. During the expansion stroke, the piston 4 moves in the expansion direction E, the fuel-air intake valve 9*d* is open and the combustion gas exhaust valve 9*a* is closed, by extending valve 9*a* away from the cylinder head 2 and by rotating valve 9*d* so that apertures 13' align with fuel-air mixture inlet openings 10', and the piston rod upper 7 and lower 8 parts are in their expanded position. As a result, the fuel-air mixture is drawn into interior 11 through fuel-air mixture inlet openings 10' and apertures 13' along paths M. During the compression stroke, the piston 4 moves in the compression direction C, both the fuel-air intake valve 9*c* and the combustion gas exhaust valve 9*a* are closed, by extending valve 9*a* away from the cylinder head 2 and by rotating valve 9*d* so that apertures 13' do not align with fuel-air mixture inlet openings 10', and the piston rod upper 7 and lower 8 parts are in their retracted position. As a result, the fuel-air mixture is compressed in interior 11 while the combustion chamber of length l is created at the top dead center position, and the fuel-air mixture is thereafter ignited. During the power stroke, the piston 4 moves in the expansion direction E, both the fuel-air intake valve 9*d* and the combustion gas exhaust valve 9*a* remain closed, and the piston rod upper 7 and lower 8 parts are in their retracted position. The combustion gases expand in interior 11, thereby forcing the piston rod down and providing power to the engine. Finally, during the exhaust stroke, the piston 4 moves in the compression direction C, the fuel-air intake valve 9*d* remains closed and the combustion gas exhaust valve 9*a* is opened, by retracting valve 9*a* toward the cylinder head 2 into space 12, and the piston rod upper 7 and lower 8 parts are in their extended position. As a result, the combustion gases are forced out of interior 11, through valve opening 10, along path G. No combustion chamber exists during the exhaust stroke because the piston rod is in its extended position and has extended the full distance l corresponding to the length of the combustion chamber. Because neither the fuel-air intake valve 9*d* nor the combustion gas exhaust valve 9*a* extend into the interior 11, and because the piston rod upper 7 and lower 8 parts are in their extended position during the exhaust stroke, the piston head 5 meets and is contiguous with the cylinder head 2 in the top dead center position, exhausting all of the expansion gases from interior 11.

Figure 15B:
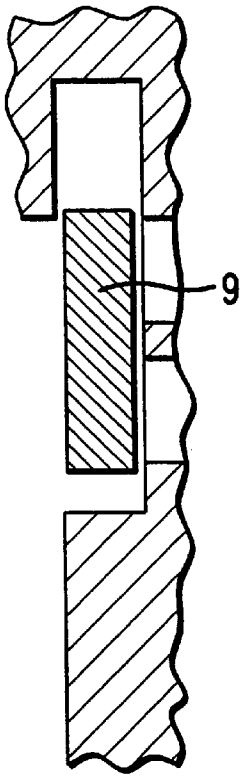
FIGS. 15*a* and 15*b* are partial schematic cross-sectional views of the embodiment of FIG. 15.
Figure 15A:
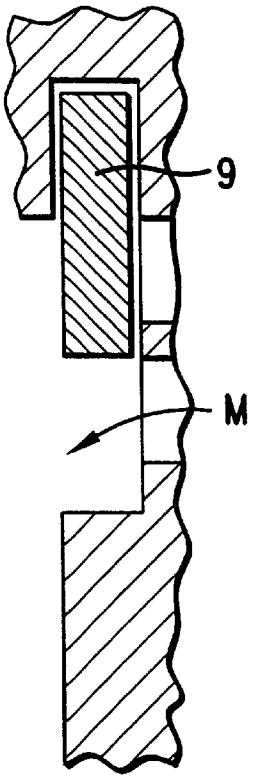
Figure 15:
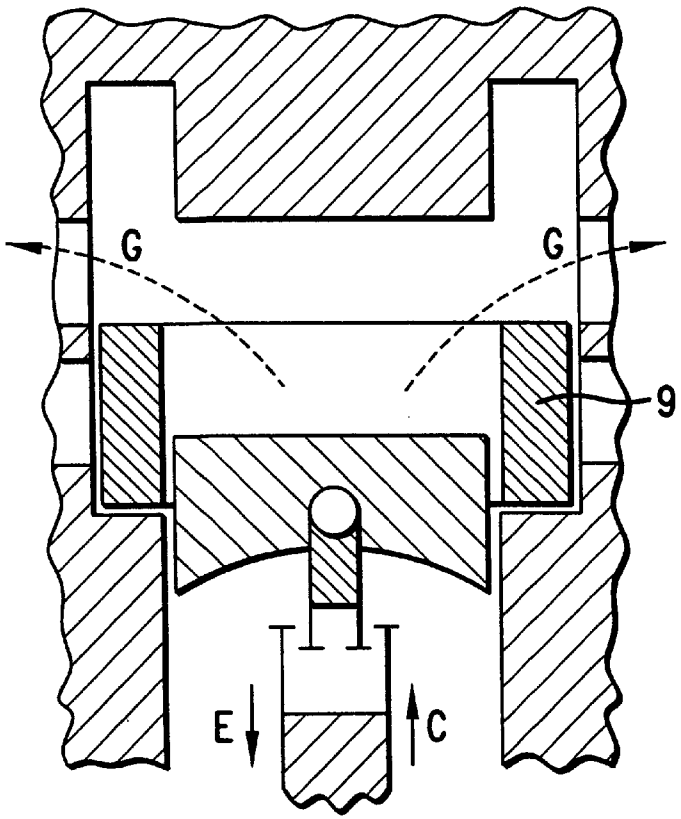
FIG. 15 is a schematic cross-sectional view of a seventh embodiment of the present invention, during an exhaust stroke.

FIGS. 15, 15*a* and 15*b* are schematic cross-sectional views of a seventh embodiment of the present invention. In the embodiment of FIGS. 15, 15*a* and 15*b*, the fuel-air intake valve and combustion gas exhaust valve are combined into a single non-apertured reciprocating valve 9 of the type shown in FIG. 12. During the expansion stroke (FIG. 15*a*), the piston moves in the expansion direction E, the fuel-air intake is open and the combustion gas exhaust is closed, by reciprocating valve 9 to the position of FIG. 15*a*, and the piston rod upper and lower parts are in their expanded position. As a result, the fuel-air mixture is drawn into interior through the fuel-air mixture inlet opening along path M. During the compression stroke, the piston moves in the compression direction C, both the fuel-air intake and the combustion gas exhaust are closed, by reciprocating valve 9 into the position of FIG. 15*b*, and the piston rod upper and lower parts are in their retracted position. As a result, the fuel-air mixture is compressed in interior while the combustion chamber of length l is created at the top dead center position, and the fuel-air mixture is thereafter ignited. During the power stroke, the piston moves in the expansion direction E, both the fuel-air intake and the combustion gas exhaust remain closed, and the piston rod upper and lower parts are in their retracted position. The combustion gases expand in the interior, thereby forcing the piston rod down and providing power to the engine. Finally, during the exhaust stroke, the piston moves in the compression direction C, the fuel-air intake is closed and the combustion gas exhaust is opened, by reciprocating valve 9 to the position of FIG. 15, and the piston rod upper and lower parts are in their extended position. As a result, the combustion gases are forced out of the interior, along path G. No combustion chamber exists during the exhaust stroke because the piston rod is in its extended position and has extended the full distance l corresponding to the length of the combustion chamber. Because the neither the valve does not extend into the interior, and because the piston rod upper and lower parts are in their extended position during the exhaust stroke, the piston head meets and is contiguous with the cylinder head in the top dead center position, exhausting all of the expansion gases from the interior.

The ring valves of the present invention are constructed of a suitable material, and of suitable dimensions, so that they can withstand the elevated internal pressures that exist within the combustion chamber and during compression, combustion and expansion of the combustion gases, with minimal deformation. The ring valves of the present invention preferably have an inner circumferential surface which is flush with the inner circumferential surface of the cylinder, thereby acting as a continuation of the cylinder wall. Because the combustion gas outlet valve is located at the axial limit of the closed end of the cylinder, and because the piston head, during the exhaust stroke, meets and is contiguous with the cylinder head, complete displacement of all combustion gases from the cylinder is assured prior to the intake stroke. Accordingly, combustion gases have no adverse impact on the fuel-air ratio of the present internal combustion engine, greatly increasing the efficiency of the engine.

The piston of the present invention is a variable-length piston, which assumes a first, extended, length during the exhaust stroke and a second, retracted, length during the compression stroke. Although the preferred embodiment of the present invention uses a piston rod which varies in length, the present invention also contemplates a piston head which moves relative to a fixed-length piston rod, to thereby assume the extended and retracted positions.

While the invention has been described in the specification and illustrated in the drawings with reference to preferred embodiments, it will be understood by those skilled in the art that various changes may be made and equivalents may be substituted for elements of the invention without departing from the scope of the claims.

What is claimed is:

1. An internal combustion engine comprising:

a variable-length piston having an extended position and a retracted position, the piston comprising a piston head and a piston rod;

a cylinder, the piston being reciprocally mounted in the cylinder, the cylinder having a circumferential inner wall and a closed end;

at least one ring valve, the at least one ring valve being mounted in the cylinder adjacent the closed end, the at least one ring valve moving from an open position to a closed position, the at least one ring valve forming an upper end of the circumferential inner wall of the cylinder, wherein the at least one ring valve is a combustion gas outlet valve, and wherein the at least one ring valve is a non-apertured, reciprocating ring valve; and at least one inlet valve, wherein the at least one inlet valve is a poppet valve;

whereby during a compression stroke of the engine, the at least one ring valve is in the closed position and the piston is in the retracted position, and during an exhaust stroke of the engine, the at least one ring valve is in the open position and the piston is in the extended position, the piston thereby creating a combustion chamber only during the compression stroke.

2. The internal combustion engine of claim 1, wherein:

the closed end comprises a valve groove, the at least one ring valve reciprocating into the valve groove in the open position.

3. The internal combustion engine of claim 1, wherein:

the piston rod comprises a first part and a second part, the first part and the second part being mounted for relative reciprocation.

4. The internal combustion engine of claim 3, further comprising:

a spring located between the first part and the second part.

5. The internal combustion engine of claim 4, wherein:

the spring is a compression spring.

6. The internal combustion engine of claim 3, wherein:

the first part and the second part are mounted for relative reciprocation a distance equal to a length of the combustion chamber.

7. An internal combustion engine comprising:

a variable-length piston having an extended position and a retracted position, the piston comprising a piston head and a piston rod;

a cylinder, the piston being reciprocally mounted in the cylinder, the cylinder having a circumferential inner wall and a closed end; and at least one ring valve, the at least one ring valve being mounted in the cylinder adjacent the closed end, the at least one ring valve moving from an open position to a closed position, the at least one ring valve forming an upper end of the circumferential inner wall of the cylinder, wherein the at least one ring valve is a combustion gas outlet valve, and wherein the at least one ring valve is a non-apertured, reciprocating ring valve;

whereby during a compression stroke of the engine, the at least one ring valve is in the closed position and the piston is in the retracted position, and during an exhaust stroke of the engine, the at least one ring valve is in the open position and the piston is in the extended position, the piston thereby creating a combustion chamber only during the compression stroke.

8. The internal combustion engine of claim 7, wherein:

the closed end comprises a valve groove, the at least one ring valve reciprocating into the valve groove in the open position.

9. An internal combustion engine comprising:

a variable-length piston having an extended position and a retracted position, the piston comprising a piston head and a piston rod;

a cylinder, the piston being reciprocally mounted in the cylinder, the cylinder having a circumferential inner wall and a closed end; and at least one ring valve, the at least one ring valve being mounted in the cylinder adjacent the closed end, the at least one ring valve moving from an open position to a closed position, the at least one ring valve forming an upper end of the circumferential inner wall of the cylinder; and at least one inlet valve, wherein the at least one inlet valve is a non-apertured, reciprocating ring valve;

whereby during a compression stroke of the engine, the at least one ring valve is in the closed position and the piston is in the retracted position, and during an exhaust stroke of the engine, the at least one ring valve is in the open position and the piston is in the extended position, the piston thereby creating a combustion chamber only during the compression stroke.

10. The internal combustion engine of claim 9, wherein:

the at least one ring valve is a combustion gas outlet valve, and wherein the at least one ring valve is a non-apertured, reciprocating ring valve.

11. The internal combustion engine of claim 10, wherein:

the closed end comprises a valve groove, the at least one ring valve reciprocating into the valve groove in the open position.

12. The internal combustion engine of claim 9, wherein:

the at least one ring valve is a combustion gas outlet valve, and wherein the at least one ring valve is an apertured, rotary ring valve.

* * * * *